US005370391A

United States Patent [19]

Hilzendeger et al.

[11] Patent Number: 5,370,391

[45] Date of Patent: Dec. 6, 1994

[54] SPIRAL SLIDE BALL GAME

[76] Inventors: Joey D. Hilzendeger, Box 5; Arthur J. Schloss, Box 195, both of Napoleon, N. Dak. 58561

[21] Appl. No.: 231,499

[22] Filed: Apr. 22, 1994

[51] Int. Cl.[5] ..... A63F 7/00

[52] U.S. Cl. ..... 273/118 R; 273/138 R; 273/170 R; 273/112

[58] Field of Search ..... 273/118, 120, 108, 112, 273/138 R

[56] References Cited

U.S. PATENT DOCUMENTS

| | | | |
|---|---|---|---|
| 452,194 | 5/1891 | Prendergast . | |
| 2,525,716 | 10/1950 | Okamoto . | |
| 3,778,320 | 5/1971 | Goldfarb et al. | 273/120 R |
| 3,934,881 | 1/1976 | Goldfarb et al. | 273/120 R X |
| 3,989,252 | 11/1976 | Mattson | 273/138 R |
| 4,260,155 | 4/1981 | Jordan | 273/120 R |
| 4,274,630 | 6/1981 | Kulesza et al. | 273/120 R X |
| 5,197,735 | 3/1993 | Land . | |
| 5,301,942 | 4/1994 | Lacrosse | 273/138 R |

FOREIGN PATENT DOCUMENTS

| | | |
|---|---|---|
| 2725545 | 12/1978 | Germany . |
| 1277893 | 6/1972 | United Kingdom . |

*Primary Examiner*—V. Millin
*Assistant Examiner*—Raleigh W. Chiu
*Attorney, Agent, or Firm*—Richard C. Litman

[57] ABSTRACT

The present invention is a game apparatus capable of temporarily storing a plurality of spherical game pieces, and then consecutively and independently releasing each of these game pieces into any one of a plurality of compartments. Included is a spiral passageway and a tubular funnel through which each game piece travels before being randomly directed into one of the compartments. If desired one or more of the compartments could be obstructed to prevent the entrance of game pieces thereinto.

20 Claims, 4 Drawing Sheets

FIG. 3
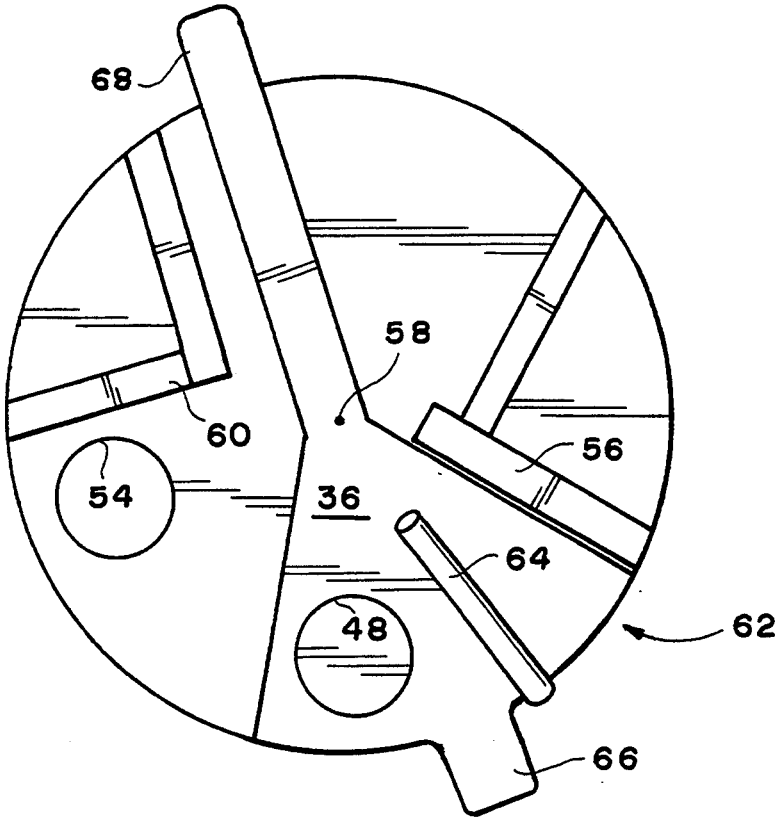
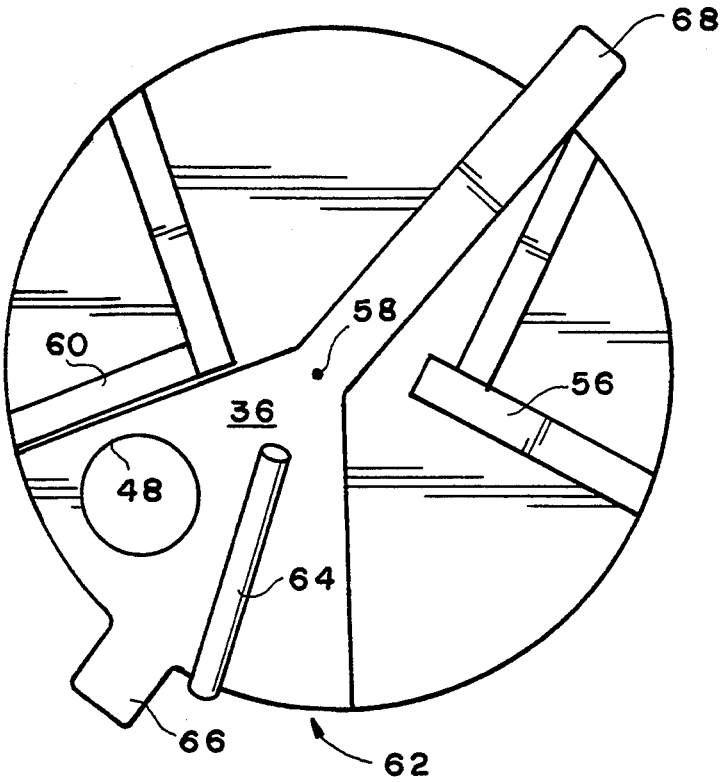
FIG. 4

SPIRAL SLIDE BALL GAME

BACKGROUND OF THE INVENTION

1. Field of the Invention

The present invention relates to a game apparatus utilizing a plurality of spherical game pieces that are randomly directed into any one of a plurality of compartments. More particularly, the present invention relates to a game apparatus wherein the plurality of spherical game pieces are consecutively and independently released from a ball bin prior to being directed into one of the plurality of compartments.

2. Description of the Prior Art

Games of chance often utilize one or more spherical game pieces randomly directed into one of a plurality of compartments. U.S. Pat. No. 2,525,716 issued to Yoshigusu Okamoto on Oct. 10, 1950, discloses a drop ball lottery machine having a rotatable ball bin with a plurality of ball receiving holes therein. Positioned upon the underside of the bin is a circular plate, movable in relation to the bin. Apertures within the plate are alignable with the holes in the bin to allow the balls to be dropped onto a tray. This tray is sloped for inducing the balls to roll into one of a plurality of variously numbered compartments.

U.S. Pat. No. 452,194 issued to James Prendergast on May 12, 1891, shows a game apparatus capable of generating a random sequence of numbers. This apparatus includes a bowl for receiving a plurality of balls. Each of these balls travels through a tubular neck positioned at the base of the bowl. Located directly beneath the tubular neck is a ball deflector for guiding each of the balls onto a rotating base. When the rotation of the base ceases, each of the balls is positioned within one of a plurality of variously numbered compartments.

A similar device is shown in British Pat. No. 1 277 893 issued to Julie M. Samson on Jun. 14, 1972. This patent illustrates a random number selector having 12 sequentially numbered ball receiving compartments arranged around the periphery of a circular base. A ball is dropped into a passageway that leads to a deflector positioned at the center of the base. The ball contacts the deflector and rebounds into one of the compartments. The number generated corresponds to the compartment within which the ball comes to rest.

Other games of chance utilizing one or more spherical game pieces are shown in German Patent 27 25 545 issued to Fritz Muller on Dec. 21, 1978, and U.S. Pat. No. 5,197,735 issued to Larry D. Land, et al. on Mar. 30, 1993. The Muller patent discloses an apparatus wherein a single ball is guided onto a deflector, and then randomly deflected into one of many numbered compartments. The Land, et al. patent illustrates a game piece randomizer having a tubular body that leads to a compartmented base. A ball or similar article is released into the main body, where its path is randomly altered by a plurality of obstruction pieces. The players can position these game pieces in a random or predetermined pattern to provide a plurality of passageways through which the ball can pass.

None of the above inventions and patents, taken either singly or in combination, is seen to describe the instant invention as claimed.

SUMMARY OF THE INVENTION

The present invention is a game apparatus capable of temporarily storing a plurality of spherical game pieces, and then consecutively and independently releasing each of these game pieces into any one of a plurality of compartments. When the game pieces are stored within the apparatus, they are not visible to onlookers. However, each game piece is visible when it is released from storage and placed upon a spiral passageway. After traveling through this passageway, the released game piece enters a tubular funnel where it travels upon a substantially horizontal rim that extends around the internal perimeter of the funnel. Upon falling from this funnel, the game piece is randomly directed into one of the compartments. In the event the game is played by a number of participants that is less than the number of compartments, a blocking device may be utilized to prevent the game pieces from entering any of the non-used compartments.

Accordingly, it is a principal object of the invention to provide a novel game apparatus capable of consecutively and independently releasing a plurality of game pieces into any one of a plurality of compartments.

It is another object of the invention to provide a novel game apparatus that incorporates a spiral passageway through which each game piece travels.

It is a further object of the invention to provide a novel game apparatus that incorporates a tubular funnel through which each game piece travels.

Still another object of the invention is to provide a novel game apparatus having a mechanism for preventing any one of the plurality of game pieces from entering any of the plurality of compartments.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 3 is an enlarged, partial, top plan view of a first position of the movable transfer device of the invention.

FIG. 4 is an enlarged, partial, top plan view of a second position of the movable transfer device of the invention.

Similar reference characters denote corresponding features consistently throughout the attached drawings.

DETAILED DESCRIPTION OF THE PREFERRED EMBODIMENT

Figure 1:
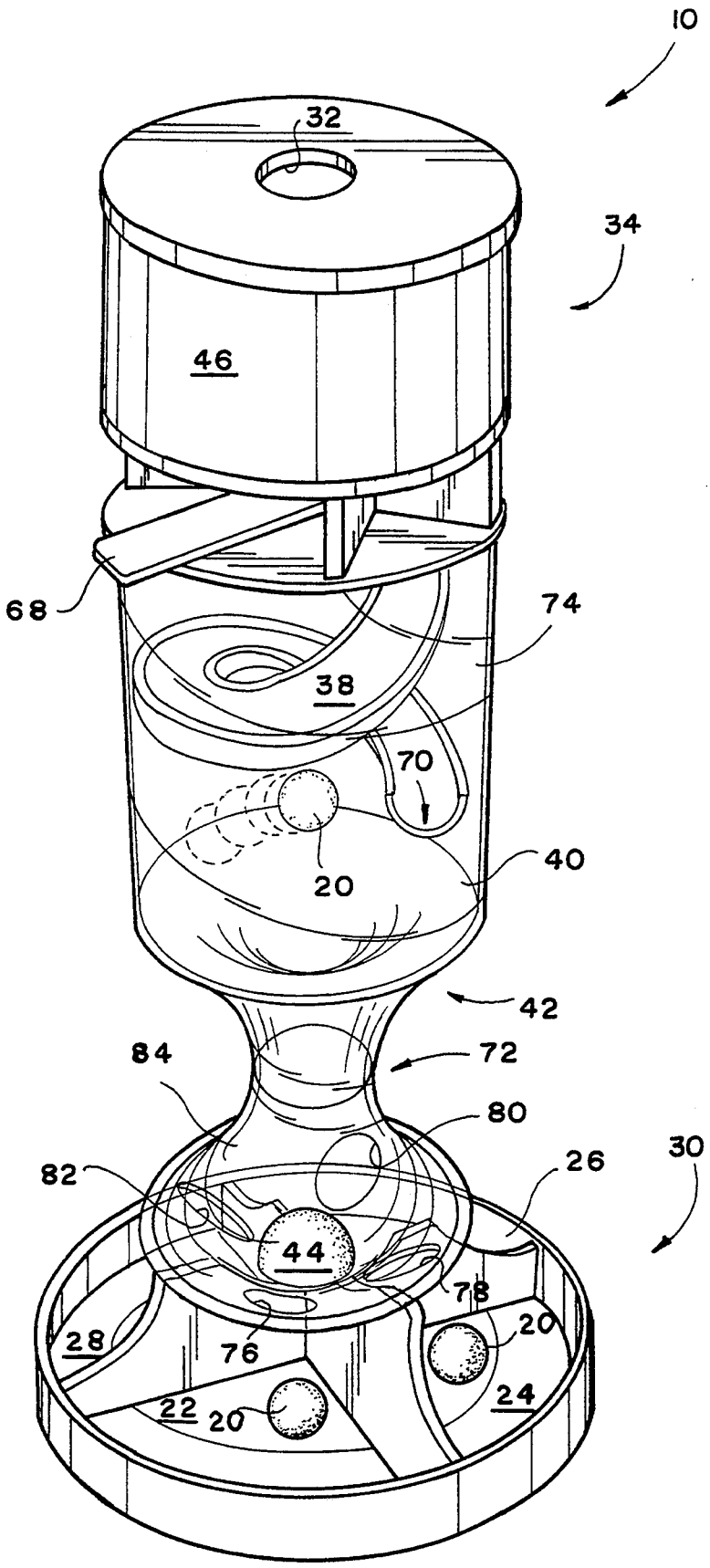
FIG. 1 is a perspective view of the game apparatus of the invention.

Referring to FIG. 1, the present invention is a game apparatus 10 for randomly distributing a plurality of spherical game pieces 20 or balls into any one of a plurality of compartments 22,24,26,28 positioned within the apparatus base 30. Initially, each of the balls 20 are passed through the opening 32 to be temporarily stored within a ball bin 34. Each ball 20 is then independently released from bin 34 and carried to a spiral slide 38. After traveling upon spiral slide 38, the released ball 20 rolls upon a rim 40 formed at the upper portion of a funnel 42. Gravity forces pull the released ball 20 through funnel 42 and onto a deflector 44, which randomly directs the released ball 20 into one of the compartments 22,24,26 or 28. In FIG. 1, compartments 22,24 are depicted to each have a ball 20 therein, and a third ball 20 is shown to be encircling rim 40.

Figure 2:
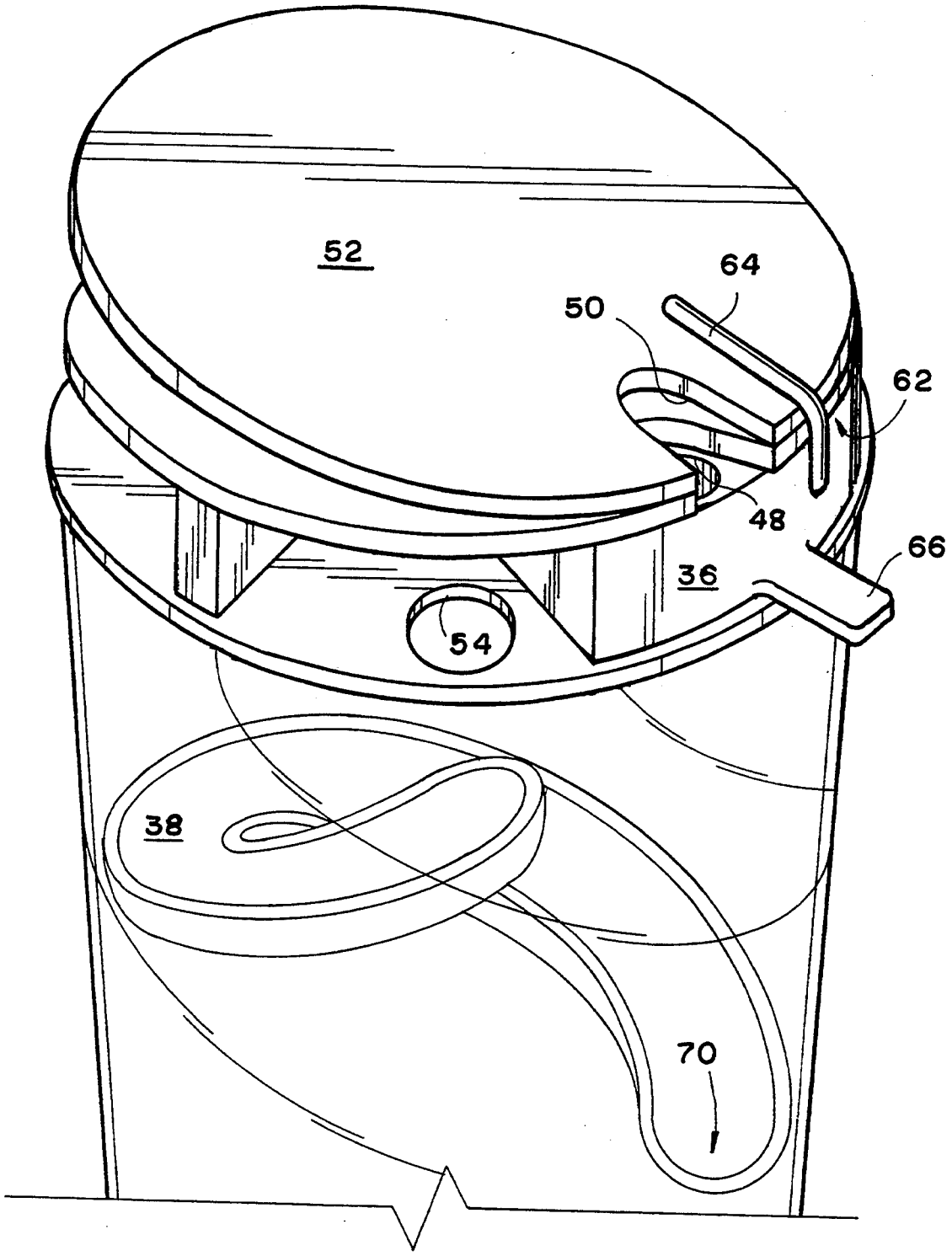
FIG. 2 is an enlarged, partial perspective view of the game apparatus of FIG. 1.

FIG. 2 depicts bin 34 without its exterior wall 46. This figure shows the movable transfer device 36 which carries released ball 20 to the spiral slide 38. In the figure, movable transfer device 36 is illustrated to be positioned such that its opening 48 is aligned with an aperture 50 in the bin underside 52. This aperture 50 is dimensioned such that it cannot simultaneously receive more than one ball 20. Therefore, although sloped underside 52 compels all of the stored balls 20 toward aperture 50, only one ball 20 is permitted to enter aperture 50. This ball 20 falls through aperture 50 and enters opening 48. The ball 20 is then carried to spiral slide 38 by moving transfer device 36 until opening 48 is aligned with hole 54, positioned directly above spiral slide 38.

The various positions of transfer device 36 are illustrated in FIGS. 3 and 4, both of which are top plan views of apparatus 10 with exterior wall 46 and underside 52 removed therefrom. In FIG. 3, transfer device 36 is shown to be abutting a stop 56. This is the same position as that shown in FIG. 2, where opening 48 of transfer device 36 is located to receive a single ball 20. In FIG. 4, transfer device 36 has been pivoted upon pin 58, and is abutting stop 60. In this position, opening 48 is aligned with hole 54, and the ball 20 held within transfer device 36 is dropped onto spiral slide 38. When in this position, a portion 62 of the top surface of transfer device 36 blocks aperture 50 to prevent any balls 20 from exiting bin 34.

As transfer device 36 is moved from the position shown in FIG. 3 to the position shown in FIG. 4, the arm 64 is shifted across aperture 50, illustrated in FIG. 2. Therefore, as transfer device 36 is moved, all balls 20 within bin 34 are pushed away from aperture 50. One effect of this forced movement of balls 20 is to randomize the positioning of the balls 20 within bin 34, thus preventing any participant from knowing what ball 20 is to be released next. This is important when apparatus 10 is utilized with variously colored balls, as described below. A second effect of the forced movement of balls 20 is to prevent transfer device 36 from jamming. As each of the balls 20 are pushed away from aperture 50, there is no possibility that any ball 20 within bin 34 can block movement of transfer device 36 by becoming partially disposed within opening 48.

The movement of transfer device 36 is facilitated by first and second handles 66,68, shown in FIGS. 3 and 4. These handles 66,68 protrude outward from opposite sides of transfer device 36 to allow participants seated around apparatus 10 to have easy access to the device 36. This eliminates the necessity to reach across apparatus 10, therefore promoting the comfort of each participant, and also minimizing the likelihood that a participant will inadvertently jar or knock over apparatus 10.

After a ball 20 is dropped from transfer device 36, it travels upon spiral slide 38, and then encounters funnel 42, depicted in FIG. 1. The base 70 of spiral slide 38 is generally aligned with the interior perimeter of funnel 42 to assure that the released ball 20 travels circuitously within funnel 42. The top of this funnel 42 includes rim 40 angled at slightly less than horizontal. The ball 20 continuously encircles rim 40, until succumbing to gravity forces, which draw ball 20 through the neck portion 72.

The amount of time that ball 20 remains in funnel 42 is substantially dependent upon the length and slope of spiral slide 38. When spiral slide 38 is configured with a substantial length and slope, ball 20 repetitively encircles rim 40, before falling through neck portion 72. As funnel 42 and the casing 74 are translucent, the participants can watch ball 20 as it repetitively encircles rim 40. When apparatus 10 is utilized with balls of varying colors, this repetitive encircling considerably enhances viewing excitement, as the participants can determine if the ball encircling rim 40 is of a color they require to win the game.

Figure 5:
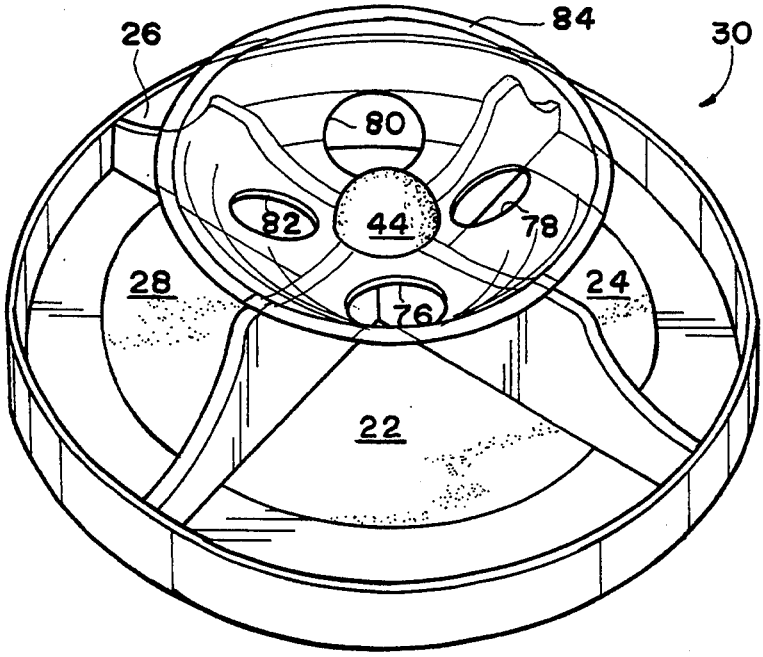
FIG. 5 is an enlarged, perspective view of the base of the game apparatus of FIG. 1.
Figure 6:
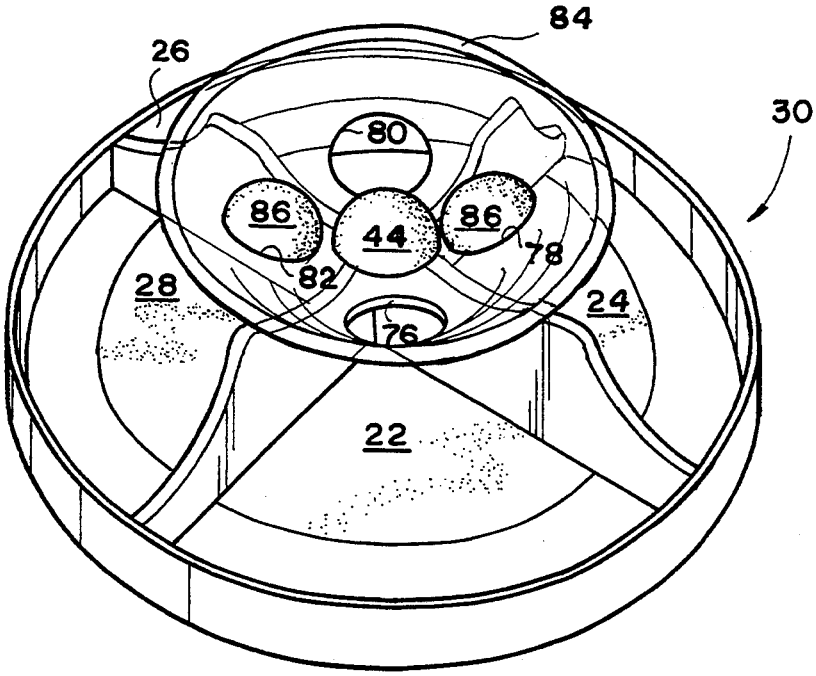
FIG. 6 is an enlarged, perspective view of the base of the game apparatus of the invention, showing the use of two barricades.
Figure 7:
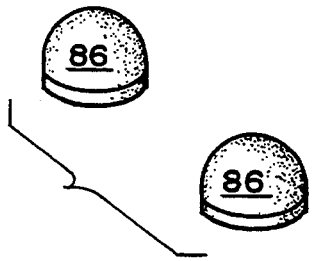
FIG. 7 is an enlarged, perspective view of the two barricades of FIG. 6.

After encircling rim 40, the ball 20 travels through neck portion 72, which delivers the ball 20 to semi-spherical deflector 44, shown most clearly in FIG. 5. Upon contacting deflector 44, ball 20 is randomly directed through one of the orifices 76,78,80,82 in the shield 84. Each orifice 76,78,80,82 is a passageway to the compartments 22,24,26,28, respectively. To prevent one or more of the released balls 20 from entering any of compartments 22,24,26 or 28, a barricade 86 or plug can be positioned within any of the orifices 76,78,80 or 82, as shown in FIG. 6. Two of these barricades 86,86 are illustrated in FIG. 7, and each has a semi-spherical outer surface to assure a random deflection of the balls 20 bouncing therefrom. Although these barricades 86,86 are configured for a frictional attachment to the portions of shield 84 forming each orifice 76,78,80,82, any appropriate attachment method, such as a groove formed around the perimeter of the barricades, could suffice.

The preferred method of utilizing apparatus 10 is a four participant game that utilizes thirteen balls 20. Four of these balls are a first color, four are a second color, four are a third color, and one is a fourth color. The object of the game is to be the first participant whose compartment 22,24,26 or 28 contains only 1 ball of the first color, one ball of the second color, and 1 ball of the third color.

To begin the game, all of the balls 20 are placed within bin 34, where they are not visible to the participants or onlookers. A participant then maneuvers transfer device 36 to release one of the balls 20 from bin 34, down spiral slide 38, around rim 40, through funnel 42, and into one of the four compartments 22,24,26 or 28. If this ball is of the fourth color, it must be returned to bin 34, otherwise it stays untouched. The remaining balls are then consecutively and independently released from bin 34 in the manner described above. If the ball of the fourth color enters a participant's compartment 22,24,26 or 28, he or she must return all of the balls 20 in his or her compartment 22,24,26 or 28 back to bin 34. If any participant's compartment 22,24,26 or 28 receives a ball that is the same color as a ball currently inside his or her compartment 22,24,26 or 28, that ball must be returned back to bin 34. This process continues until one player's compartment 22,24,26 or 28 contains only 1 ball of the first color, one ball of the second color, and 1 ball of the third color.

Although the figures illustrate apparatus 10 to have four compartments 22,24,26,28, a similar apparatus could be manufactured to include any number of compartments. If there are either more or fewer than four participants, the number of balls 20 of each color is modified to correspond to the number of participants. Additionally, if there are more compartments than participants, the appropriate orifices may be obstructed, in the manner described above.

It is to be understood that the present invention is not limited to the sole embodiment described above, but encompasses any and all embodiments within the scope of the following claims.

We claim:

1. A game apparatus comprising:

a bin for storing a plurality of spherical game pieces, said bin having an aperture therein;

a base having a plurality of compartments;

means for consecutively and independently releasing each of said plurality of spherical game pieces through said aperture; and means for randomly guiding each one of said released spherical game pieces into one of said plurality of compartments.

2. The game apparatus according to claim 1, wherein said means for consecutively and independently releasing comprise a movable transfer device, there further being an opening defined therein, said opening being alignable with said aperture to permit one of said plurality of spherical game pieces to travel from said bin into said opening, said movable transfer device being capable of carrying any one of said plurality of spherical game pieces to said means for randomly guiding.

3. The game apparatus according to claim 2, wherein said movable transfer device further comprises an arm extending into said bin, said arm being positioned so as to partially obstruct said aperture when said movable transfer device is shifted from a position where said aperture is aligned with said opening to a position where said aperture is not aligned with said opening.

4. The game apparatus according to claim 1, wherein said means for randomly guiding include a spiral slide.

5. The game apparatus according to claim 4, said apparatus being configured such that each of said plurality of spherical game pieces is substantially visible to an onlooker when said each of said plurality of spherical game pieces is traveling upon said spiral slide.

6. The game apparatus according to claim 4, wherein said means for randomly guiding further include a tubular funnel having a substantially horizontal rim for each of said plurality of spherical game pieces to travel upon before exiting said tubular funnel.

7. The game apparatus according to claim 6, wherein said tubular funnel is fabricated from a substantially translucent material.

8. The game apparatus according to claim 1, further comprising at least one blocking device for selectively preventing each of said plurality of spherical game pieces from entering at least one of said plurality of compartments.

9. The game apparatus according to claim 8, wherein said at least one blocking device comprises:

a shield obstructing said compartments, said shield having a plurality of orifices, each of said plurality of orifices being dimensioned to permit the passage of each of said plurality of spherical game pieces, the number of said plurality of orifices corresponding to the number of said plurality of compartments; and at least one removable barricade for obstructing at least one of said plurality of orifices.

10. A game apparatus comprising:

a bin for storing a plurality of spherical game pieces, said bin having an aperture therein;

a base having a plurality of compartments;

means for releasing each of said plurality of spherical game pieces through said aperture;

means for randomly guiding each one of said released spherical game pieces into one of said plurality of compartments; and at least one blocking device for preventing each of said plurality of spherical game pieces from entering at least one of said plurality of compartments.

11. The game apparatus according to claim 10, wherein said means for releasing comprise a movable transfer device, there further being an opening defined therein, said opening being alignable with said aperture to permit one of said plurality of spherical game pieces to travel from said bin into said opening, said movable transfer device being capable of carrying any one of said plurality of spherical game pieces to said means for randomly guiding.

12. The game apparatus according to claim 11, wherein said movable transfer device further comprises an arm extending into said bin, said arm being positioned so as to partially obstruct said aperture when said movable transfer device is shifted from a position where said aperture is aligned with said opening to a position where said aperture is not aligned with said opening.

13. The game apparatus according to claim 10, wherein said means for randomly guiding include a spiral slide.

14. The game apparatus according to claim 13, said apparatus being configured such that each of said plurality of spherical game pieces is substantially visible to an onlooker when said each of said plurality of spherical game pieces is traveling upon said spiral slide.

15. The game apparatus according to claim 13, wherein said means for randomly guiding further include a tubular funnel, a portion of said tubular funnel having a substantially horizontal rim for each of said plurality of spherical game pieces to travel upon before exiting said tubular funnel.

16. The game apparatus according to claim 10, wherein said tubular funnel is fabricated from a substantially translucent material.

17. The game apparatus according to claim 10, wherein said at least one blocking device comprises:

a shield obstructing said compartments, said shield having a plurality of orifices, each of said plurality of orifices being dimensioned to permit the passage of each of said plurality of spherical game pieces, the number of said plurality of orifices corresponding to the number of said plurality of compartments; and at least one removable barricade for obstructing at least one of said plurality of orifices.

18. A game apparatus comprising:

a bin for storing a plurality of spherical game pieces, said bin having an aperture therein;

a base having a plurality of compartments;

means for releasing each of said plurality of spherical game pieces through said aperture;

means for randomly guiding each one of said released spherical game pieces into one of said plurality of compartments, said means for randomly guiding including a spiral slide, said apparatus being configured such that each of said plurality of spherical game pieces is substantially visible to an onlooker when said each of said plurality of spherical game pieces is traveling upon said spiral slide; and at least one blocking device for selectively preventing each of said plurality of spherical game pieces from entering at least one of said plurality of compartments.

19. The game apparatus according to claim 18, further comprising a movable transfer device, there further being an opening defined therein, said opening being alignable with said aperture to permit one of said plurality of spherical game pieces to travel from said bin into said opening, said movable transfer device being capable of carrying any one of said plurality of spherical game pieces to said means for randomly guiding.

20. The game apparatus according to claim 18, wherein said movable transfer device further comprises an arm extending into said bin, said arm being positioned so as to partially obstruct said aperture when said movable transfer device is shifted from a position where said aperture is aligned with said opening to a position where said aperture is not aligned with said opening.

* * * * *